US008850976B2

(12) United States Patent
Jeter

(10) Patent No.: US 8,850,976 B2
(45) Date of Patent: Oct. 7, 2014

(54) INKER ASSEMBLY FOR CYLINDRICAL CAN DECORATORS

(76) Inventor: James M. Jeter, Jacksonville, FL (US)

( * ) Notice: Subject to any disclaimer, the term of this patent is extended or adjusted under 35 U.S.C. 154(b) by 70 days.

(21) Appl. No.: 13/348,064

(22) Filed: Jan. 11, 2012

(65) Prior Publication Data

US 2013/0174753 A1 Jul. 11, 2013

(51) Int. Cl.
*B41F 31/15* (2006.01)
*B41F 31/00* (2006.01)

(52) U.S. Cl.
USPC ..... 101/350.3; 101/352.06

(58) Field of Classification Search
USPC ..... 101/350.3, 352.06, DIG. 38, 351.1, 101/351.3, 352.01, 352.04, 350.1
See application file for complete search history.

(56) References Cited

U.S. PATENT DOCUMENTS

| | | | | |
|---|---|---|---|---|
| 1,995,701 | A * | 3/1935 | Buttner | 101/350.5 |
| 4,741,266 | A * | 5/1988 | Stirbis et al. | 101/40 |
| 5,062,362 | A * | 11/1991 | Kemp | 101/348 |
| 5,249,524 | A * | 10/1993 | Morris | 101/352.04 |
| 5,823,109 | A * | 10/1998 | Hummel et al. | 101/350.4 |
| 7,380,498 | B2 * | 6/2008 | Domotor | 101/350.3 |
| 2012/0272846 | A1 * | 11/2012 | Fleischer et al. | 101/38.1 |

* cited by examiner

*Primary Examiner* — Ren Yan
*Assistant Examiner* — Leo T Hinze
(74) *Attorney, Agent, or Firm* — The Livingston Firm PA; Edward M. Livingston, Esq.; Bryan L. Loeffler, Esq.

(57) ABSTRACT

A cylindrical can decorator inker assembly having a non-oscillating first transfer roll, a non-oscillating second transfer roll and a non-oscillating third transfer roll, and further having axially oscillating distributor and ghost chaser rolls to prevent ghosting on the decorated cans. The inker assembly preferably has an improved oscillator drive assembly, oscillating roll structure, transfer roll structure and inker assembly mount.

15 Claims, 11 Drawing Sheets

INKER ASSEMBLY FOR CYLINDRICAL CAN DECORATORS

BACKGROUND OF THE INVENTION

This invention relates generally to the field of cylindrical can decorating or printing equipment, and more particularly relates to inker assemblies utilized in such can decorating equipment.

Decorating equipment that apply ink to cans or similarly shaped articles using offset printing techniques are known. Ink of a particular color is transferred from an ink fountain assembly to a plate cylinder and printing blanket by an inker assembly comprising a number of rotating rolls or drums, the ink. Certain rolls known as transfer rolls are typically ceramic coated, while other rolls known as doctor rolls, distributor rolls and form rolls are coated with a closed cell polymer. In known designs the transfer rolls are axially oscillated relative to the other rolls to preclude "ghosting", the unwanted retention and transfer of a printing plate image on the rollers where the ink has been removed and not reapplied or smoothed by the oscillating rolls. This creates problems in that the oscillating transfer rolls are composed of steel, are water cooled and gear driven, which requires significant energy to operate and will produce vibration in the system from the inertia resulting from the rapid axial movement. Significant heat is generated in the transfer rolls, which results in frequent shaft seal failure and leaking oil. Gear driven systems also require water cooling of the oil in the gearbox, which often results in oil leaks near the printing plates and blankets. The gear driven systems do not provide for independent adjustment of the oscillating frequency during operation. Furthermore, current designs are not easily disassembled, such that removal of the inker assembly for cleaning or replacement is time and labor intensive. Current designs have other problems in addition to those listed above, and it is an object of this invention to address a number of problems inherent in the current designs.

SUMMARY OF THE INVENTION

In general, the invention in various embodiments is, in a basic embodiment, a cylindrical can decorator inker assembly, said inker assembly conveying ink from an ink fountain assembly to a plate cylinder, wherein said ink fountain assembly comprises a fountain well, a fountain roll and a ductor roll, and wherein said plate cylinder rotates an image plate against a blanket roll, said inker assembly comprising a non-oscillating first transfer roll intermittently contacted by said ductor roll of said ink fountain assembly; a non-oscillating second transfer roll; and a non-oscillating third transfer roll. In a more complex embodiment, the invention is a cylindrical can decorator inker assembly, said inker assembly conveying ink from an ink fountain assembly to a plate cylinder, wherein said ink fountain assembly comprises a fountain well, a fountain roll and a ductor roll, and wherein said plate cylinder rotates an image plate against a blanket roll, said inker assembly comprising a non-oscillating first transfer roll intermittently contacted by said ductor roll of said ink fountain assembly; a non-oscillating distributor roll in contact with said first transfer roll; a non-oscillating second transfer roll in contact with said non-oscillating distributor roll; a first and second axially oscillating distributor roll both in contact with said second transfer roll; a non-oscillating third transfer roll in contact with said first and second axially oscillating distributor rolls; a first non-oscillating form roll and a second non-oscillating form roll, both in contact with said third transfer roll and with said plate cylinder; and a first axially oscillating ghost chaser roll in contact with said first non-oscillating form roll and a second axially oscillating ghost chaser roll in contact with said second non-oscillating form roll.

In possible embodiments, said first, second and third transfer rolls are driven independently from said plate cylinder and are driven by at least one timing belt. In possible embodiments, the inker assembly comprises an oscillator drive assembly, said oscillator drive assembly oscillating said first and second axially oscillating distributor rolls and said first and second axially oscillating ghost chaser rolls, the oscillator drive assembly in possible embodiments comprising a variable speed motor such that the rate of oscillation of said first and second axially oscillating distributor rolls and said first and second axially oscillating ghost chaser rolls can be varied. In possible embodiments said oscillator drive assembly further comprises a timing belt driving an oscillating mechanism comprising cams and drive rods, said drive rods contacting plungers in said first and second axially oscillating distributor rolls and said first and second axially oscillating ghost chaser rolls.

In possible embodiments, the inker assembly further comprises a first set of front and rear pivoting plates and a second set of front and rear pivoting plates, said first set and second set of pivoting plates each pivoting about the axis of said third transfer roll, wherein said first form roll and said first axially oscillating ghost chaser roll are mounted to said first set of pivoting plates and wherein said second form roll and said second axially oscillating ghost chaser roll are mounted to said second set of pivoting plates, whereby said first and second form rolls are pivotable out of contact with said plate cylinder while remaining in contact with said third transfer roll.

In possible embodiments said first and second axially oscillating distributor rolls and said first and second axially oscillating ghost chaser rolls are mounted in quick release brackets.

In possible embodiments, said first and second axially oscillating distributor rolls and said first and second axially oscillating ghost chaser rolls are mounted onto an outer sleeve coaxially mounted onto a fixed inner shaft, wherein said outer sleeve is axially movable relative to said inner shaft, said inner shaft having an axial bore open on one end, said axial bore retaining a return spring and a plunger rod extending from and axially movable relative to said inner shaft, wherein said outer sleeve is connected to said plunger rod by a mechanical member extending through a pair of slots in said inner shaft, such that axial movement of said plunger rod causes axial movement of said outer sleeve relative to said inner shaft.

In possible embodiments, said first, second and third transfer rolls are mounted onto water-cooled shafts retained within bearings such that said water-cooled shafts are able to rotate, said transfer rolls comprising a water-receiving internal cavity, each end of said transfer rolls comprising a first annular recess having a first depth and a first outer diameter, a pair of bolt-receiving bores, and a second annular recess having a second depth and a second outer diameter, wherein said first depth is lesser than said second depth and said second diameter is lesser than said first diameter; said inker assembly further comprising mounting flanges, mounting bolts and O-rings; wherein said transfer rolls are mounted to said water-cooled shafts by a pair of said mounting flanges, said mounting flanges comprising a collet portion adapted to encircle said water-cooled shafts, a radially-extending flange portion received by said first annular recess, a pair of bolt-receiving bores disposed in said flange portion, and an annular shoulder extending inwardly from said flange portion, wherein said annular shoulder is received within said second annular recess; wherein with said O-rings encircling said water-cooled shafts and disposed within said second annular recesses, and with mounting bolts inserted into said bolt-receiving bores of said mounting flanges and said transfer rolls, tightening of said mounting bolts causes said annular shoulders to compress said O-rings against said water-cooled shafts.

DETAILED DESCRIPTION OF THE INVENTION

The invention comprises in general an inker assembly for a can decorator, or more broadly a can decorator comprising the described inker assembly and the methodology of decorating cans using the inker assembly. With reference to the drawings, the invention will be described in detail with regard for the best mode and the preferred embodiments. The term "axially oscillating" or variations thereof shall be taken herein to define back-and-forth reciprocal movement in the axial direction, and the term "non-oscillating" or variations thereof shall be taken herein to define non-movement in the axial direction. When the terms describe a roll, the roll is able to rotate about the axis whether it is an axially oscillating roll or a non-oscillating roll.

Figure 1:
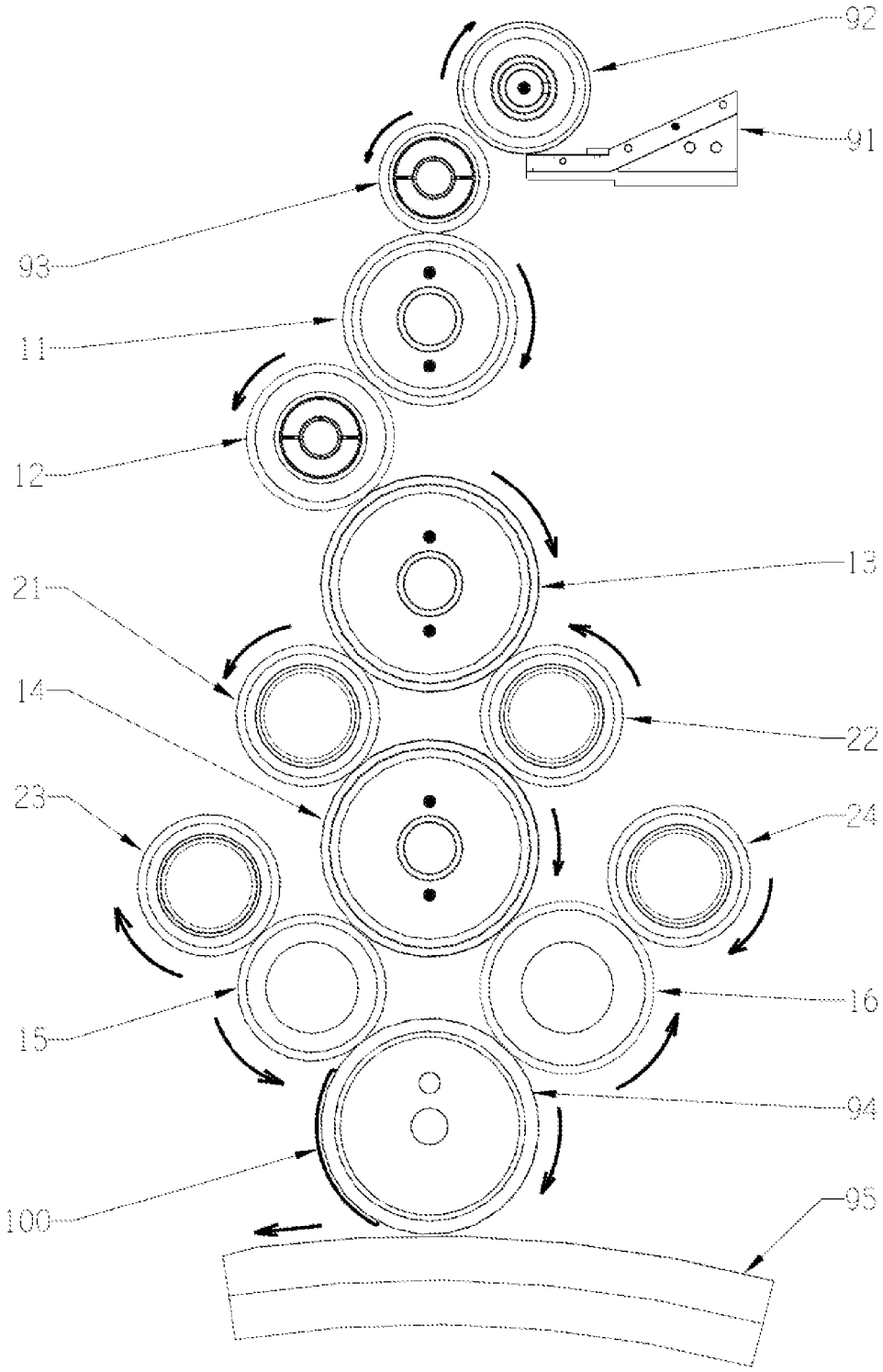
FIG. 1 is a schematic showing the relative positions of the rolls of the inker assembly, as well as the ink fountain assembly, plate cylinder and a portion of the blanket drum, as well as the rotation direction of the rotating members.
Figure 2:
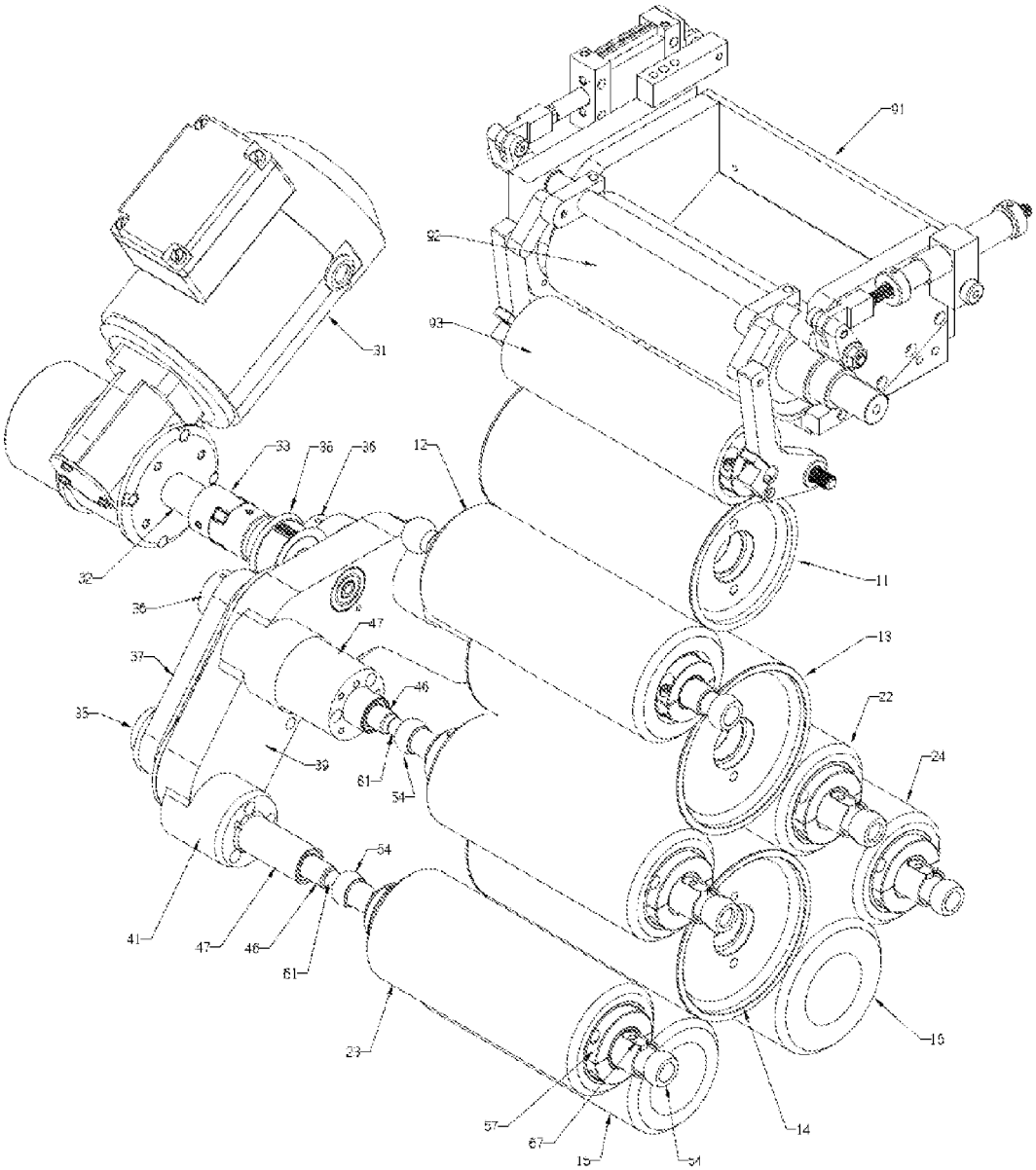
FIG. 2 is a perspective view showing the rolls and the oscillator drive assembly of the inker assembly, as well as the ink fountain assembly.

As seen best in FIGS. 1 and 2, the cylindrical can decorator inker assembly is an assembly for conveying ink from an ink fountain assembly to a plate cylinder 94 comprising an image plate 100, as is known in the art. Ink is conveyed from the inker first form roll 15 and second form roll 16 to a printing plate cylinder and to a rubber blanket located on the blanket drum 95. A typical ink fountain assembly comprises a fountain well 91 to receive and retain a supply of ink, a rotating fountain roll 92 in contact with the ink in the fountain well 91, and a ductor roll 93 intermittently in contact with the fountain roll 92, the ductor roll 93 reciprocating to convey ink from the fountain roll 92 to the first transfer roll 11 of the inker assembly. The ductor roll 93 is preferably reciprocating pneumatically, but other reciprocating mechanisms may be utilized. The fountain roll 92 may be driven by a timing belt connected to a speed reducer comprising a set of reduction gears, the speed reducer being connected to the first transfer roll 11 by another timing belt. As is known, a fountain blade is used to control ink distribution on the fountain roll 92, and keys actuated by ball bearings or other mechanisms may be used to raise and lower sections of the fountain blade.

The inker assembly comprises a plurality of drums or rolls that define an ink conveyance pathway such that contact between the rotating rolls results in the ink being passed from one roll or rolls to the next roll or rolls in the pathway. As shown, the inker assembly comprises in combination a non-oscillating first transfer roll 11, a non-oscillating second transfer roll 13 and a non-oscillating third transfer roll 14. More completely, the inker assembly comprises a non-oscillating first transfer roll 11 intermittently contacted by the ductor roll 93 of the ink fountain assembly, a non-oscillating distributor roll 12 in contact with the first transfer roll 11, a non-oscillating second transfer roll 13 in contact with the non-oscillating distributor roll 12, at least one distributor roll but preferably a first axially oscillating distributor roll 21 and a second axially oscillating distributor roll 22, both in contact with the second transfer roll 13, a non-oscillating third transfer roll 14 in contact with said first and second axially oscillating distributor rolls 21 and 22, at least one form roll but preferably a first non-oscillating form roll 15 and a second non-oscillating form roll 16, both in contact with the third transfer roll 14 and with the plate cylinder 94; and at least one ghost chaser but preferably a first axially oscillating ghost chaser roll 23 in contact with said first non-oscillating form roll 15 and a second axially oscillating ghost chaser roll 24 in contact with said second non-oscillating form roll 16. The axes of the various rolls are aligned in parallel. As is known in the art, the first transfer roll 11, the second transfer roll 13 and the third transfer roll 14 may and will likely have ceramic-coated cylindrical surfaces, while the remaining rolls may and will likely have cylindrical surfaces coated with a closed cell polymer or similar resilient material.

In inker assemblies having multiple rolls, a problem known as ghosting, the undesired retention of ink on the rolls which results in misprints or overprints on the cylindrical cans, must be addressed. In more basic systems, correction of the ghosting problem may require redesign of the label being printed or attempting difficult timing adjustments. The solution to this problem is to axially oscillate certain of the rolls, while other rolls in the inker assembly remain fixed in the axial direction. In the inker assembly as described herein, the first, second and third transfer rolls 11, 13 and 14 are non-oscillating.

The first, second and third transfer rolls 11, 13 and 14 of the inker assembly are powered, while the remaining rolls of the inker assembly are friction driven from contact with the powered rolls. Preferably, the first, second and third transfer rolls 11, 13 and 14 are driven by a single, clutched drive source, the clutch allowing the instantaneous stoppage of the inker roll train, with a first timing belt connecting the drive source to the second transfer roll 13 and either the first or third transfer rolls 11 and 14, and a second transfer belt that connects the second transfer roll 13 to the other of the first or third transfer rolls 11 and 14, and to an idler pulley or tensioner device. The first, second and third transfer rolls 11, 13 and 14 require relatively complex mounting mechanisms, shafts and power connections, are significantly heavier than the other rolls in the inker assembly and must be water cooled during operation to prevent excessive heat build-up. Therefore, the ghosting problem is addressed by making the first, second and third transfer rolls 11, 13 and 14, the distributor roll 12 and the first and second form rolls 15 and 16 of the inker assembly non-oscillating in the axial direction, while the first and second distributor rolls 21 and 22 and the first and second ghost chaser rolls 23 and 24 are axially oscillating rolls. By oscillating the lighter first and second distributor rolls 21 and 22 and the lighter first and second ghost chaser rolls 23 and 24, less power is required and less vibration is directed to the inker assembly.

Figure 5:
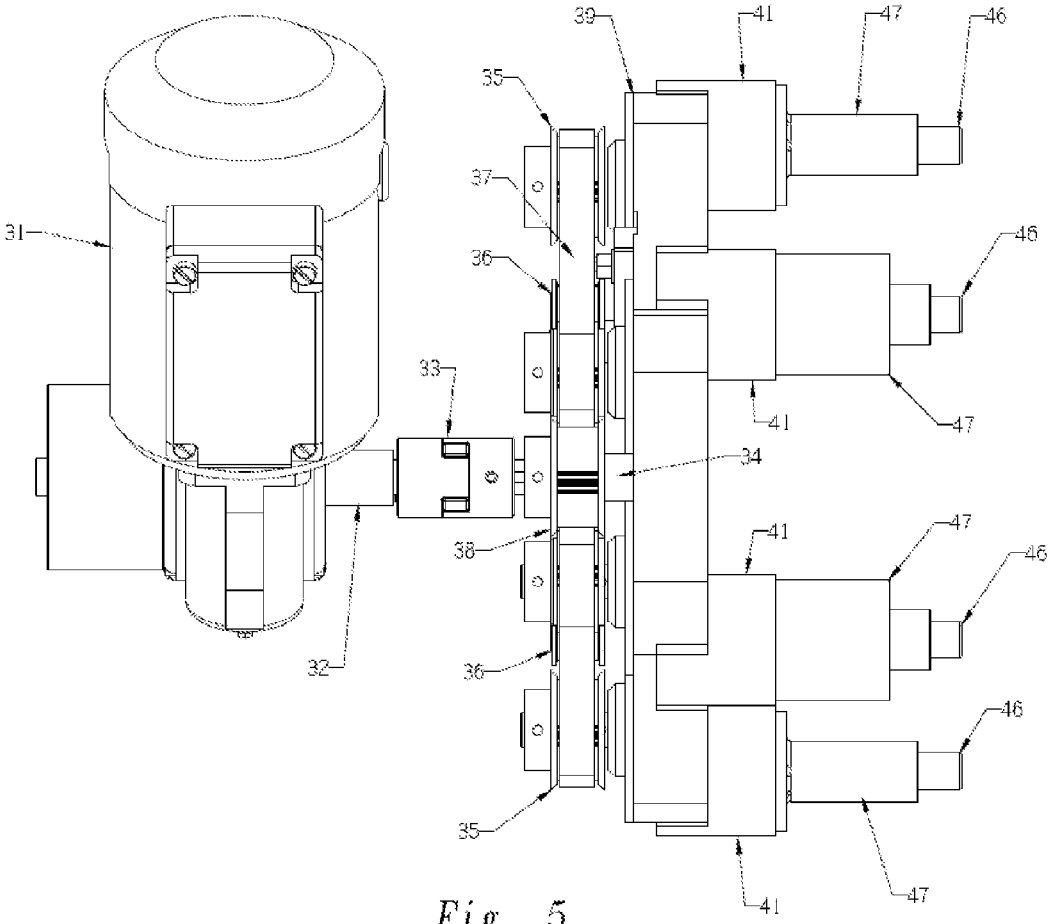
FIG. 5 is a view of the oscillator drive assembly for the oscillating rolls.
Figure 6:
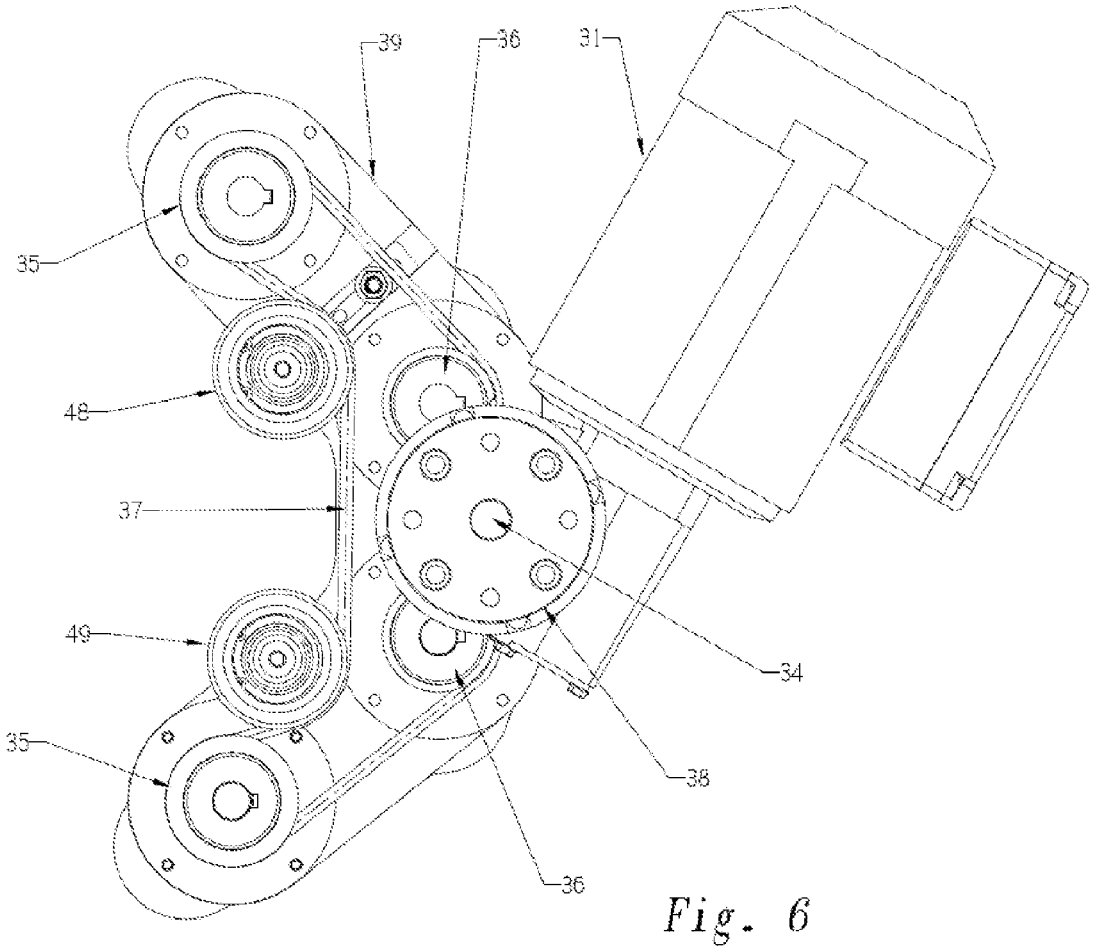
FIG. 6 is a view of the oscillator drive assembly and oscillating rolls showing the belt pathway.

A preferred embodiment of the oscillator drive assembly is shown best in FIGS. 2, 5 and 6, the oscillator drive assembly preferably comprising a variable speed drive motor 31 that rotates a drive shaft 32 and an input drive shaft 34 through a jaw coupling 33, the jaw coupling 33 being readily separable in the axial direction. This feature, in combination with other features to be later described, allows the rolls of the inker assembly to be separated from certain operational components and axially advanced for easier access during inspection, repair or replacement. The input drive shaft 34 is connected to a drive pulley 38 which drives an oscillating drive belt 37, preferably a timing belt, received by the ghost roll drive pulleys 35 and the distributor roll drive pulleys 36 retained by the oscillating drive housing 39. The timing belt 37 is also received by a tensioner pulley 48 and an idler pulley 49.

Figure 8:
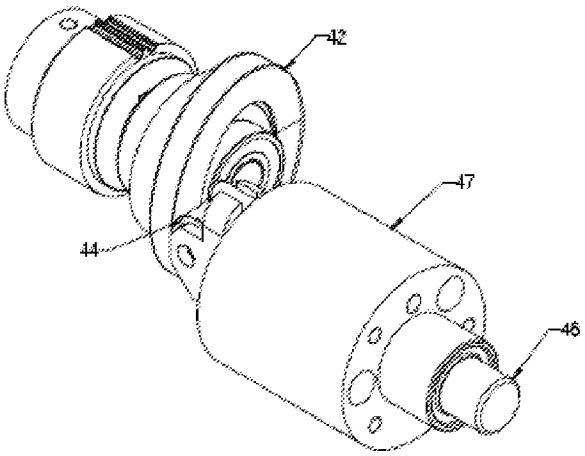
FIGS. 7, 8 and 9 are various views of the cam oscillating assembly for the oscillating rolls.
Figure 9:
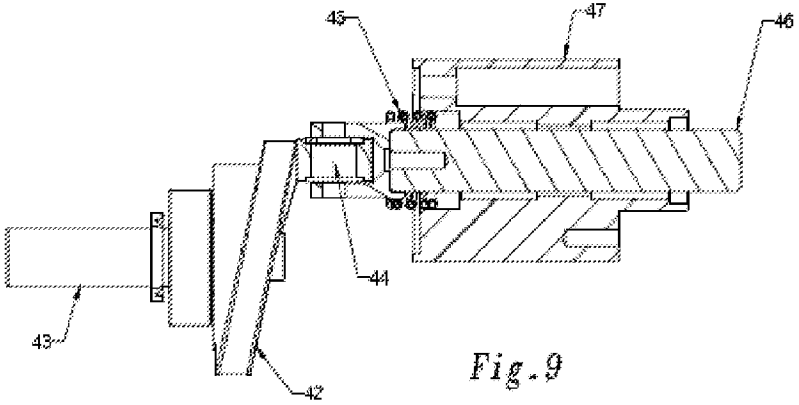
Figure 7:
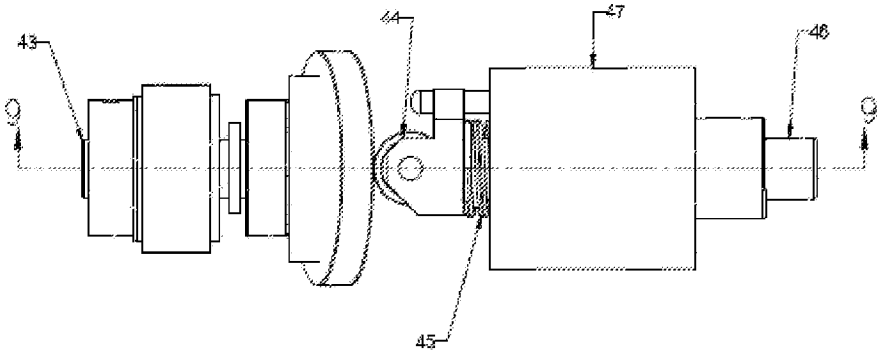

Rotation of the ghost roll drive pulleys 35 and the distributor roll drive pulleys 36 operates the oscillating mechanisms such that the ghost chaser rolls 23 and 24 and the distributor rolls 21 and 22 reciprocate or oscillate in the axial direction. A preferred embodiment of the oscillating mechanisms is shown in more detail in FIGS. 7, 8 and 9. A given oscillating mechanism comprises a cam housing 41 within which is disposed a cam shaft 43 in communication with the pulleys 35 or 36. A cam surface 42 is mounted to the cam shaft 43 whereby a cam follower 44 oscillates an oscillating plunger rod 46, a cam spring 45 maintaining the cam follower 44 in contact with the cam surface 42, the cam spring 45 and plunger rod 46 being retained within a plunger housing 47. In this manner, the plunger rods 46 axially oscillate as the cam surfaces 42 rotate. It has been found that an oscillation distance of approximately twelve millimeters is sufficient to address the ghosting problem. An oscillation rate of up to about four oscillations per second has also been found to be sufficient in certain systems. Both the distance and rate of oscillation is not critical and may vary depending on particular systems. Preferably, the oscillating roll pairs of the inker assembly are set in opposition so as to be directly out-of-phase, thereby balancing the forces and minimizing vibration in the inker assembly.

The use of a variable speed motor 31 is preferable to allow for adjustment of the oscillation rate. In current inking systems, the oscillation rate is constant, such that correction of the ghosting problem may require redesign of the label or difficult timing adjustments of the rolls. With a variable speed motor 31, the oscillating rate is initially set to be relatively slow. If ghosting occurs on the cans, the oscillation rate is increased until the ghosting disappears. When labels are changed, the process can be easily repeated to determine the optimum rate of oscillation.

Figure 3:
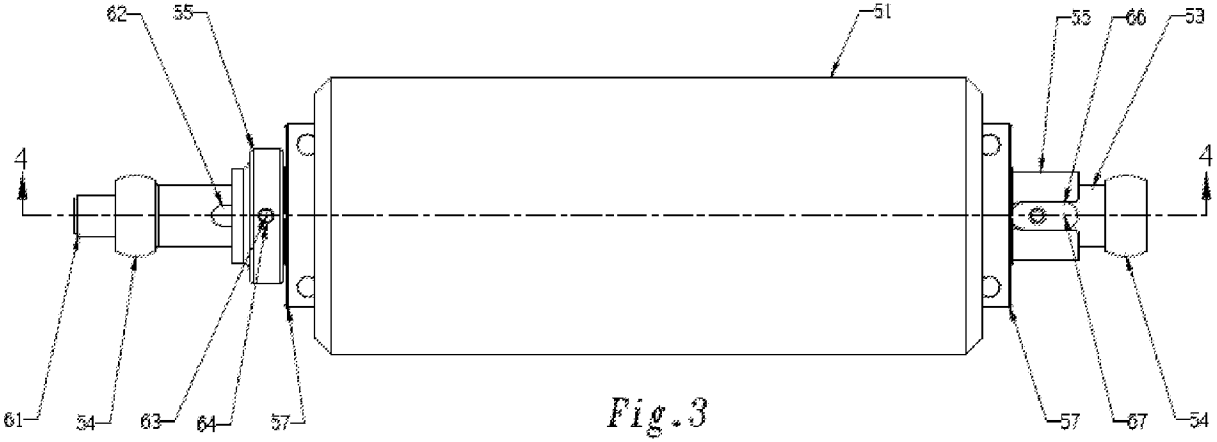
FIG. 3 is a view of an oscillating roll.
Figure 4:
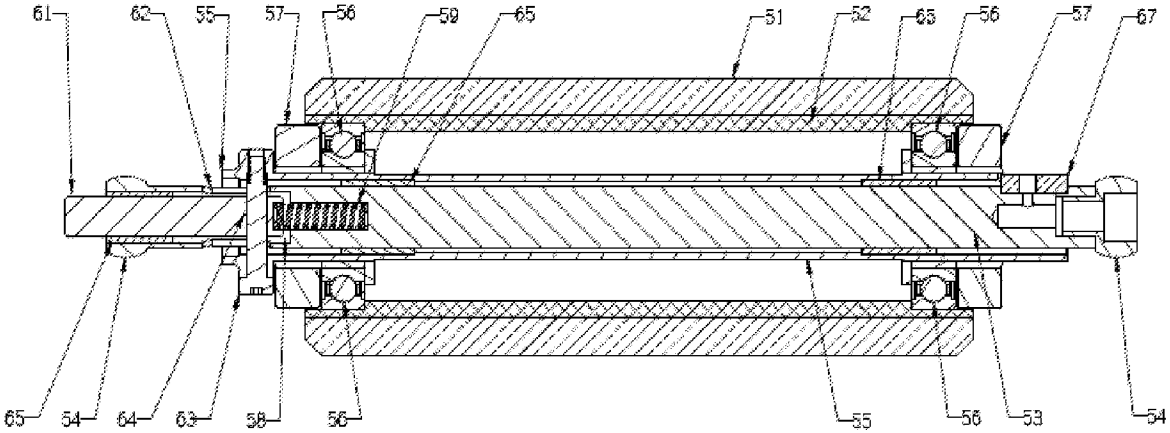
FIG. 4 is a cross-sectional view of the oscillating roll of FIG. 3 taken along line 4-4.

A preferred embodiment for the axially oscillating rolls is shown in FIGS. 3 and 4, and this structure is appropriate for the ghost chaser rolls 23 and 24 as well as the distributor rolls 21 and 22. The oscillating roll comprises a roller surface 51 mounted onto a roller core 52 which is mounted onto an outer sleeve 55. The outer sleeve 55 is coaxially mounted onto a fixed, i.e., non-oscillating, shaft 53 having a pair of annular shaft ends 54, the outer sleeve 55 being able to oscillate in the axial direction relative to the fixed shaft 53. The roller core 52 is connected to the outer sleeve 5 by a pair of bearings 56 retained on the fixed shaft 53 by a pair of locking collars 57. In this manner the roller surface 51 and roller core 52 are able to rotate about the outer sleeve 55, which does not rotate about the fixed shaft 53, but will oscillate in the axial direction along with the outer sleeve 55. A sleeve slot 66 is provided in one end of the outer sleeve 55, the sleeve slot 66 receiving an anti-rotation key 67 connected to the fixed shaft 53. The fixed shaft 53 is provided with a coaxial shaft bore 58 on one end that receives a return spring 59, the return spring 59 abutting the internally disposed end of an actuator rod 61. The actuator rod 61 preferably extends beyond the shaft end 54. A pair of opposing shaft slots 62 is provided in the fixed shaft 53 adjacent the internal portion of the actuator rod 61, the shaft slots 62 extending in the axial or longitudinal direction. A rod bore 64 transverse to the axis of the actuator rod 61 is provided in the actuator rod 61. A connector bolt 63 is inserted through the shaft slots 62 and rod bore 64, the connector bolt 63 being connected to the outer sleeve 55. Bushings 65 are disposed between the actuator rod 61 and the fixed shaft, and between the outer sleeve 55 and the fixed shaft 53.

The axially oscillating rolls are mounted such that the outer ends of the actuator rods 61 abut the outer ends of oscillating plunger rods 46, the return spring 59 providing a bias against the actuator rods 61 relative to the fixed shafts 53 such that the actuator rods 61 are extended away from the fixed shafts 53 unless moved by the oscillating plunger rods 46. In this manner, when the plunger rods 46 are individually extended by the oscillator drive assembly, return springs 59 are compressed, as seen in FIG. 4, and the actuator rods 61, the outer sleeves 55 connected to the actuator rods 61 by the connector bolts 63 positioned in the shaft slots 62, the roll cores 52 mounted to the outer sleeves 55, and the roll surfaces 51 mounted to the roll cores 52 will move axially relative to the fixed shafts 53. When the oscillating plunger rods 46 are retracted, the actuator rods 61, the outer sleeves 55, the roll cores 52 and the roll surfaces 51 are moved by the return springs 59 in the opposite axial direction relative to the fixed shafts 53.

Figure 12:
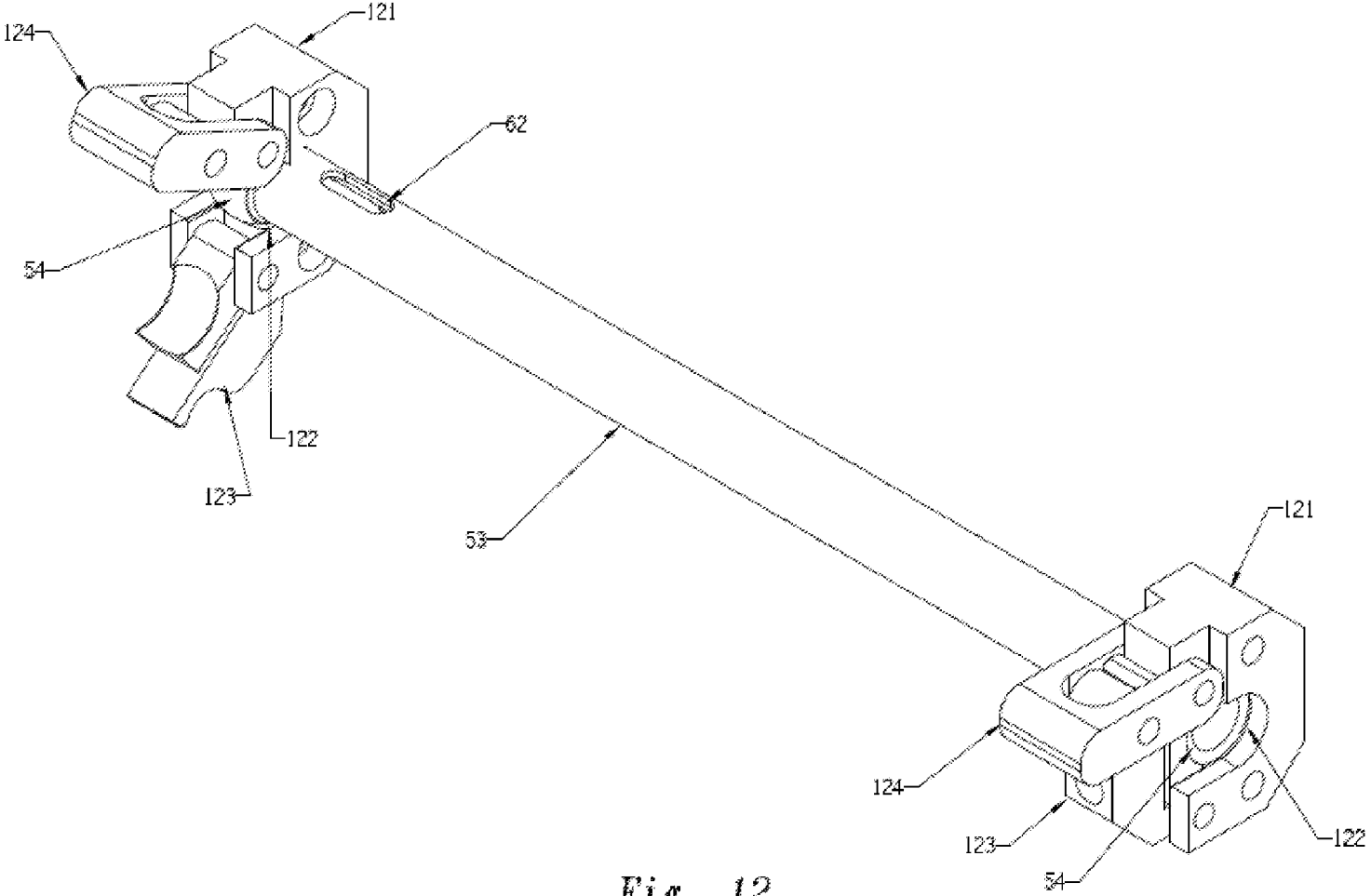
FIG. 12 shows the quick release mount assembly for the oscillating rolls.

The oscillating rolls of the inker assembly are preferably mounted in quick release brackets, as shown in FIG. 12. The quick release bracket comprises a pair of main bodies 121 each having a receiving channel 122, the receiving channel 122 being annular over about 180 degrees and sized and structured to match and receive the annular shaft ends 54 of the fixed shafts 53 of the oscillating rolls. A pivoting channel member 124, sized and structured to match and abut the annular shaft ends 54 of the fixed shafts 53, is disposed on the main body 121 in opposition to the receiving channel 122 in a manner whereby the pivoting channel member 124 can be released or opened to allow the shaft end 53 to be inserted or removed from the main body 121, and can be closed to retain the shaft end 53 within the main body 121. A releasable locking member 124 is provided to secure the pivoting channel member 123 in the retaining position.

Figure 10:
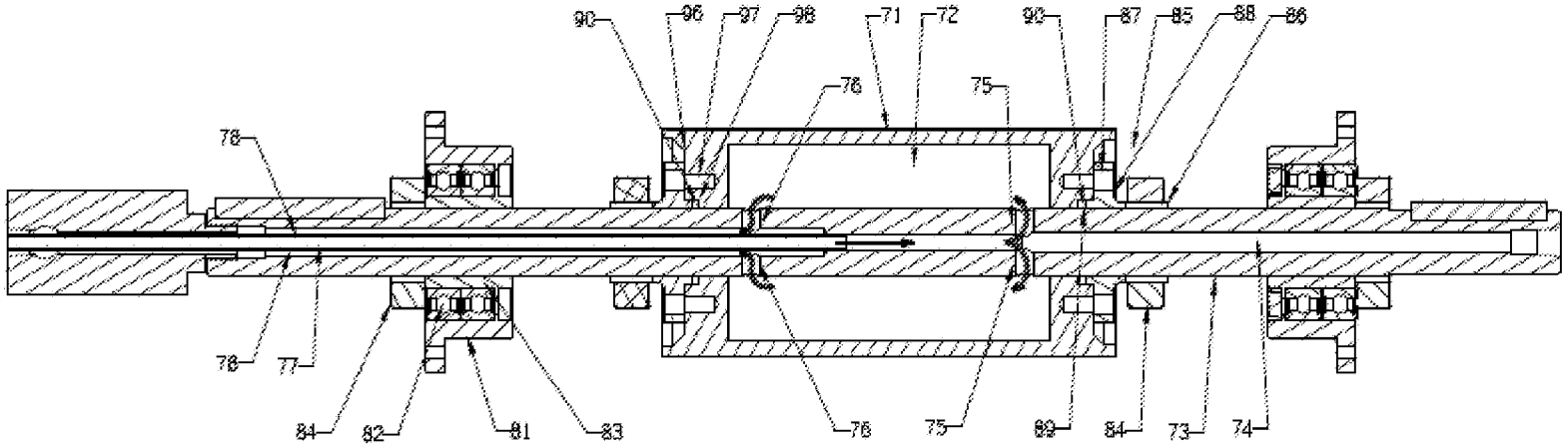
FIG. 10 is an axial cross-sectional view of a transfer roll mounted onto the shaft and showing the water cooling pathway and the mounting/sealing flanges.

The relatively heavy transfer rolls 11, 13 and 14 rotate at high speed, and high temperature build-up is a problem that must be addressed. Typically, this problem is addressed by providing a water cooling system, the water being routed through the roll shafts and into and out of the interior of the rolls to reduce the temperature through heat transfer. O-rings are utilized to provide seals between the rolls and the shafts. In current designs the O-rings are often damaged during insertion of the shaft into the roll because of shearing forces. A preferred embodiment for the transfer rolls 11, 13 and 14 is shown in FIG. 10. In this figure a transfer roll 71 is shown comprising an internal transfer roll cavity 72 that surrounds shaft 73. Shaft 73 is provided with an axial bore 74. One or more radial inflow ports 75 and one or more outflow ports 76 are provided in shaft 73, the inflow ports 75 and outflow ports 76 positioned so as to communicate with the interior cavity 72 of the transfer roll 71. The axial bore 74 is sealed on one end. A non-rotating water supply tube 77 extends through the other end of the axial bore 74 and terminates at a point between the inflow ports 75 and the outflow ports 76 of the shaft 73. Through the use of seals or, as shown, by reducing the diameter of the axial bore 74, the assembly is structured such that water flowing from the water supply tube 77 can only flow through the inflow ports 75. The water then enters the internal cavity 72 where it absorbs some of the heat, then exits through the outflow ports 76 into the axial shaft 73, the internal diameter of the axial shaft 73 being greater than the external diameter of the water supply tube 77 over the majority of the length of the water supply tube 77. The water then exits through water return ports 78. The transfer roll 71 is mounted using a pair of bearing housings 81 that retain bearings 82 and are affixed to the shaft using collets 83 and clamp collars 84.

To improve the mounting mechanism and seal between the roll 71 and the shaft 73, the transfer roll 71 comprises a pair of annular transfer roll mounting flanges 85, the mounting flanges 85 each comprising a collet portion 86 pressed onto the shaft 73 by a clamp collar 84, a radially extending flange portion 87 that abuts the ends of the roll 71, and an inwardly-facing annular shoulder portion 89. Bolt receiving bores 88 are provided in the radially extending flange portions 87. The ends of the transfer roll 71 is provided with a first annular recess 96 corresponding in size and dimensions with the radially extending flange portion 87 and a second annular recess 98 that substantially corresponds with the size and dimensions of the annular shoulder portion 89, the second annular recess being deeper than the length of the annular shoulder portion 89 such that a gap is created to receive the O-ring 90. Bolt receiving bores 97 are correspondingly positioned in the ends of roll 71 to align with the bolt receiving bores 88. With this structure, the roll 71 is slid onto the shaft 73 and the O-rings are positioned in the second annular recesses 98 of each end. The transfer roll mounting flanges 85 are then slid onto the shaft 73 to abut the ends of the roll 71, the radially extending flange portion 87 seating within the first annular recess 96 and the annular shoulder portions 89 seating within the second annular recess 98, the ends of the annular shoulder portions 89 abutting the O-rings 90. Bolts are inserted into the aligned bolt receiving bores 88 and 97 and tightened, which forces the roll mounting flanges 85 axially inward to secure the roll 71 and to compress the O-rings 90. This lateral compression of the O-rings 90 causes them to expand in the radial direction against the shaft 73, thereby creating the required seal to retain the water within the internal cavity 72 of the transfer roll 71. The collet portions 86 of the mounting flanges 85 are then secured to the shaft 73 by clamp collars 85.

Figure 11:
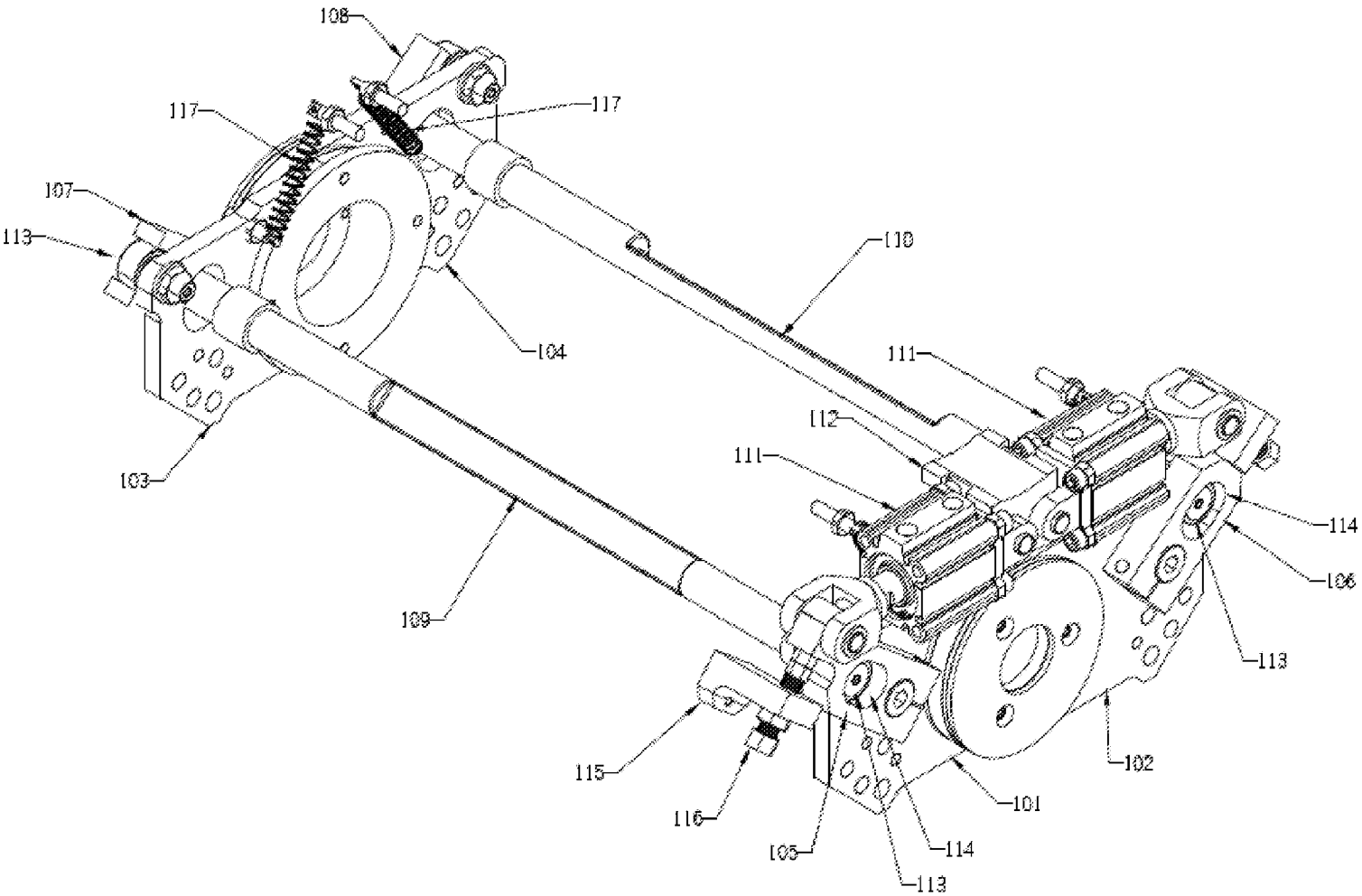
FIG. 11 shows the pivoting bracket assembly.

In the inker assembly as shown in FIGS. 1 and 2, the first and second form rolls 15 and 16 must be able to pivot away from the inker plate 100 and plate cylinder 94 while remaining in contact with the third transfer roll 14. This is accomplished by pivoting the first and second form rolls 15 and 16 about the axis of the third transfer roll 14. A preferred pivoting bracket assembly is shown in FIG. 11, the bracket assembly comprising a first front pivoting plate 101, a second front pivoting plate 102, a first rear pivoting plate 103 and a second rear pivoting plate 104. The first and second form rolls 15 and 16 are mounted to the pivoting plates 101, 102, 103 and 104. A first actuator shaft 109 extends between first front pivoting plate 101 and the first rear pivoting plate 103, and a second actuator shaft 110 extends between the second front pivoting plate 102 and the second rear pivoting plate 104. A first front link arm 105 is mounted to the first front pivoting plate 101, a second front link arm 106 is mounted to the second front pivoting plate 102, a first rear link arm 107 is mounted to the first rear pivoting plate 103, and a second rear link arm 108 is mounted to the second rear pivoting plate 104. Each link arm 105, 106, 107 and 108 comprise a cam surface 114 that receives a cam follower 113 mounted onto the pivoting plates 101, 102, 103 and 104. Pressure stop brackets 115 and pressure adjusting screws 116 are provided for adjustment as needed. The pivoting plates 101, 102, 103 and 104 are pivoted by actuating cylinders 111 retained by cylinder mounts 112, the actuating cylinders 111 being connected to the ends of the link arms 105, 106, 107 and 108. Tension springs 117 connect the pivoting plates 101, 102, 103 and 104 to the main frame of the inker assembly.

Figure 13:
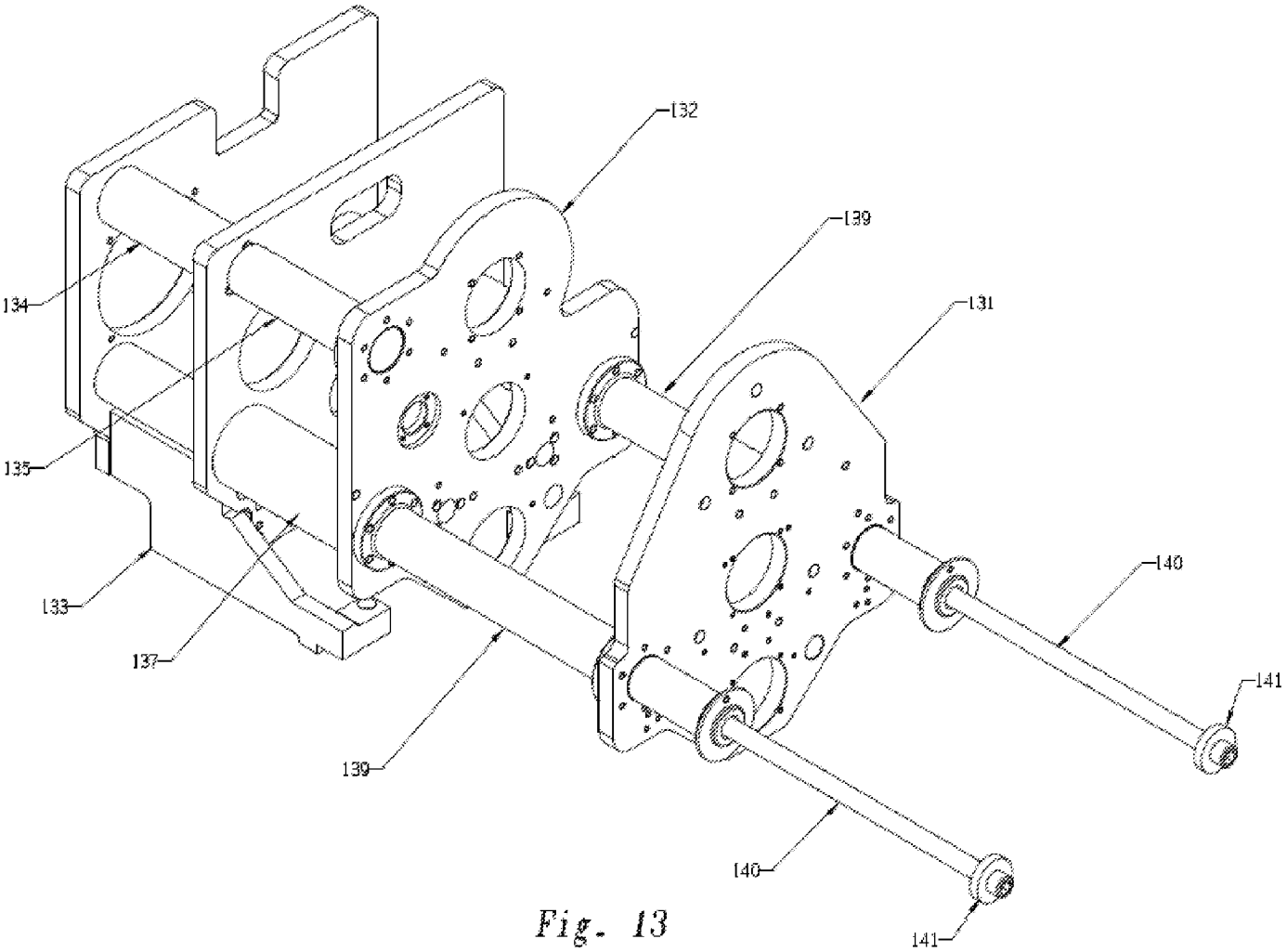
FIG. 13 is a view of the sliding inker mount.
Figure 14:
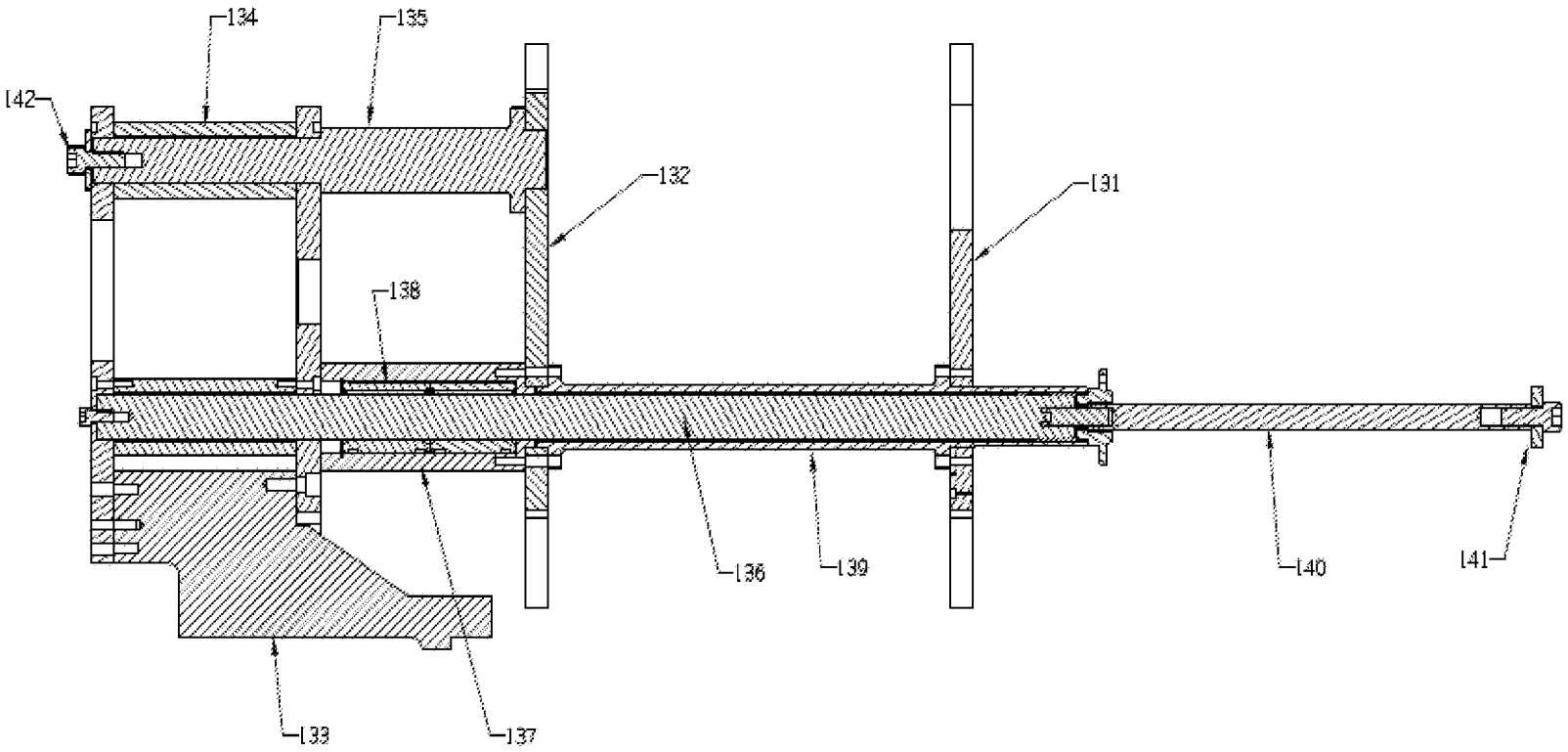
FIG. 14 is a cross-sectional view of the sliding inker mount.

To provide easier access to the various rolls of the inker assembly, a preferred inker assembly mount is provided as shown in FIGS. 13 and 14, the inker assembly mount allowing the rolls and associated structures to be advanced forward in a sliding manner. The front anchor frame plate 131 and the rear anchor frame plate 132 retain the various rolls of the inker assembly, and are mounted to a support frame 133. The support frame 133 comprises a front support plate 144 and a rear support plate 143, with an upper support sleeve 134 extending between the two support plates 143 and 144. The upper support sleeve 134 slidingly receives an upper sliding shaft 135, the end of the upper sliding shaft 135 receiving a release bolt 142 that extends through the rear support plate 143. A pair of fixed lower support shafts 136 extends forward from the support frame 133. A pair of lower sliding sleeves 139 extends between the front and rear anchor frame plates 131 and 132, and the lower sliding sleeves 139 are slidingly mounted onto the lower support shafts 136. Bushings 138 are retained within a bushing housing 137 that is mounted to the rear anchor frame plate 132 and extends rearward toward the front support plate 143. In this manner, when the release bolt 143 is removed from the upper sliding shaft 135, the upper sliding shaft 135, the rear anchor frame plate 132 the lower sliding sleeve 139 and the front anchor frame plate 131, along with the rolls and other components forming the majority of the inker assembly, can be advanced from the support frame 133 along the lower support shafts 136. A pair of limiting rods 140 having abutment caps 141 may be attached to the lower support shafts 136 to limit forward travel of the inker assembly.

It is contemplated that equivalents and substitutions for certain elements set forth above may be obvious to those of ordinary in the art, and therefore the true scope and definition of the invention is to be as set forth in the following claims.

I claim:

1. A cylindrical can decorator inker assembly, said inker assembly conveying ink from an ink fountain assembly to a plate cylinder, wherein said ink fountain assembly comprises a fountain well, a fountain roll and a ductor roll, and wherein said plate cylinder comprises an image plate rotated against a blanket roll, said inker assembly comprising:

a non-oscillating first transfer roll intermittently contacted by said ductor roll of said ink fountain assembly;

a non-oscillating distributor roll in contact with said first transfer roll;

a non-oscillating second transfer roll in contact with said non-oscillating distributor roll;

a first axially oscillating distributor roll and a second axially oscillating distributor roll, both in contact with said second transfer roll;

a non-oscillating third transfer roll in contact with said first and second axially oscillating distributor rolls;

a first non-oscillating form roll and a second non-oscillating form roll, both in contact with said third transfer roll and with said image plate of said plate cylinder; and a first axially oscillating ghost chaser roll in contact with said first non-oscillating form roll and a second axially oscillating ghost chaser roll in contact with said second non-oscillating form roll.

2. The inker assembly of claim 1, wherein said first, second and third transfer rolls are driven independently from said plate cylinder.

3. The inker assembly of claim 2, wherein said first, second and third transfer rolls are driven by at least one timing belt.

4. The inker assembly of claim 1, wherein said first, second and third transfer rolls are driven by at least one timing belt.

5. The inker assembly of claim 1, further comprising an oscillator drive assembly, said oscillator drive assembly oscillating said first and second axially oscillating distributor rolls and said first and second axially oscillating ghost chaser rolls.

6. The inkier assembly of claim 5, wherein said oscillator drive assembly comprises a variable speed motor such that the rate of oscillation of said first and second axially oscillating distributor rolls and said first and second axially oscillating ghost chaser rolls can be varied.

7. The inker assembly of claim 5, wherein said oscillator drive assembly further comprises a timing belt driving an oscillating mechanism comprising cams and drive rods, said drive rods contacting plungers in said first and second axially oscillating distributor rolls and said first and second axially oscillating ghost chaser rolls.

8. The inker assembly of claim 1, further comprising a first set of front and rear pivoting plates and a second set of front and rear pivoting plates, said first set and second set of pivoting plates each pivoting about the axis of said third transfer roll, wherein said first form roll and said first axially oscillating ghost chaser roll are mounted to said first set of pivoting plates and wherein said second form roll and said second axially oscillating ghost chaser roll are mounted to said second set of pivoting plates, whereby said first and second form rolls are pivotable out of contact with said image plate of said plate cylinder while remaining in contact with said third transfer roll.

9. The inker assembly of claim 1, wherein said first and second axially oscillating distributor rolls and said first and second axially oscillating ghost chaser rolls are mounted in quick release brackets.

10. The inker assembly of claim 1, wherein said first and second axially oscillating distributor rolls and said first and second axially oscillating ghost chaser rolls are mounted onto an outer sleeve coaxially mounted onto a fixed inner shaft, wherein said outer sleeve is axially movable relative to said inner shaft, said inner shaft having an axial bore open on one end, said axial bore retaining a return spring and a plunger rod extending from and axially movable relative to said inner shaft, wherein said outer sleeve is connected to said plunger rod by a mechanical member extending through a pair of slots in said inner shaft, such that axial movement of said plunger rod causes axial movement of said outer sleeve relative to said inner shaft.

11. The inker assembly of claim 1, wherein said first, second and third transfer rolls are mounted onto water-cooled shafts retained within bearings such that said water-cooled shafts are able to rotate, said transfer rolls comprising a water-receiving internal cavity, each end of said transfer rolls comprising a first annular recess having a first depth and a first outer diameter, a pair of bolt-receiving bores, and a second annular recess having a second depth and a second outer diameter, wherein said first depth is lesser than said second depth and said second diameter is lesser than said first diameter;

said inker assembly further comprising mounting flanges, mounting bolts and O-rings;

wherein said transfer rolls are mounted to said water-cooled shafts by a pair of said mounting flanges, said mounting flanges comprising a collet portion adapted to encircle said water-cooled shafts, a radially-extending flange portion received by said first annular recess, a pair of bolt-receiving bores disposed in said flange portion, and an annular shoulder extending inwardly from said flange portion, wherein said annular shoulder is received within said second annular recess;

wherein with said O-rings encircling said water-cooled shafts and disposed within said second annular recesses, and with mounting bolts inserted into said bolt-receiving bores of said mounting flanges and said transfer rolls, tightening of said mounting bolts causes said annular shoulders to compress said O-rings against said water-cooled shafts.

12. The inker assembly of claim 1, further comprising front and rear anchor plates retaining at least the first, second and third transfer rolls, said front and rear anchor plates are slideably mounted to a support frame via at least one sliding shaft and at least one sliding sleeve.

13. A cylindrical can decorator inker assembly, said inker assembly conveying ink from an ink fountain assembly to a plate cylinder, wherein said ink fountain assembly comprises a fountain well, a fountain roll and a ductor roll, and wherein said plate cylinder comprises an image plate rotated against a blanket roll, said inker assembly comprising:

a non-oscillating first transfer roll intermittently contacted by said ductor roll of said ink fountain assembly, a non-oscillating second transfer roll and a non-oscillating third transfer roll;

at least one distributor roll in contact with said first and second transfer rolls;

at least another one distributor roll in contact with said second and third transfer rolls;

at least one form roll in contact with said third transfer roll and said image plate of said plate cylinder;

at least one ghost chaser roll in contact with said at least one form roll;

wherein at least one of said distributor rolls and said ghost chaser roll axially oscillates; and said at least another one distributor roll in contact with said second and third transfer rolls axially oscillates and said ghost chaser roll axially oscillates.

14. The assembly of claim 13, wherein said at least another one distributor roll in contact with said second and third transfer rolls comprises two distributor rolls.

15. The inker assembly of claim 13, further comprising front and rear anchor plates retaining at least the first, second and third transfer rolls, said front and rear anchor plates are slideably mounted to a support frame via at least one sliding shaft and at least one sliding sleeve.

* * * * *